US006824233B2

(12) United States Patent
Chen et al.

(10) Patent No.: US 6,824,233 B2
(45) Date of Patent: Nov. 30, 2004

(54) TRACK DEVICE FOR DRAWERS

(75) Inventors: Ken-Ching Chen, Kaohsiung Hsien (TW); Chun-Chiang Wang, Kaohsiung Hsien (TW)

(73) Assignee: King Slide Works Co., Ltd., Kaohsiung Hsien (TW)

( * ) Notice: Subject to any disclaimer, the term of this patent is extended or adjusted under 35 U.S.C. 154(b) by 0 days.

(21) Appl. No.: 10/379,707

(22) Filed: Mar. 6, 2003

(65) Prior Publication Data

US 2004/0174102 A1 Sep. 9, 2004

(51) Int. Cl.[7] ..... A47B 88/00

(52) U.S. Cl. ..... 312/334.46; 312/334.44; 312/330.1; 312/334.1; 312/333

(58) Field of Search ..... 312/334.46, 334.44, 312/334.11, 334.1, 333, 330.1, 341 R, 348, 350; 384/21, 18, 22

(56) References Cited

U.S. PATENT DOCUMENTS 4,370,007 A * 1/1983 Fler ..... 312/334.11
5,722,750 A * 3/1998 Chu ..... 312/334.11
5,868,479 A * 2/1999 Hoffman ..... 312/334.44
6,126,255 A * 10/2000 Yang ..... 312/334.46
6,220,683 B1 * 4/2001 Chu ..... 312/334.44
6,390,575 B1 * 5/2002 Chen et al. ..... 312/334.46
6,450,600 B1 * 9/2002 Chen et al. ..... 312/334.46
6,601,933 B1 * 8/2003 Greenwald ..... 312/333
2002/0140331 A1 * 10/2002 Chen et al. ..... 312/334.46
2003/0178922 A1 * 9/2003 Chen et al. ..... 312/334.44

* cited by examiner

*Primary Examiner*—Peter M. Cuomo
*Assistant Examiner*—Erika Garrett
(74) *Attorney, Agent, or Firm*—Bacon & Thomas, PLLC

(57) ABSTRACT

A track device includes a first track and a second track. A limiting member is mounted to each of two ends of the first track. Each limiting member has two lateral walls and a groove between the lateral walls. Each limiting member further has a resilient hook extending into the groove. At least one positioning member is mounted to the first track and includes a resilient hook on a side thereof. The second track is slidably received between two guide walls of the first track. The second track includes a limiting member on each of two ends thereof. Each limiting member of the second track includes two lateral walls one of which has a non-planar inclined face for selectively sliding across and engaging with the resilient hook of the positioning member of the first track and the resilient hook of a respective limiting member of the first track.

10 Claims, 4 Drawing Sheets

TRACK DEVICE FOR DRAWERS

BACKGROUND OF THE INVENTION

1. Field of the Invention

The present invention relates to a track device for drawers allowing pulling movements in two directions.

2. Description of Related Art

FIG. 1 of the drawings illustrates a so-called "three-part" conventional track device for a drawer. The track device includes an outer track 91, a middle track 92, and an inner track 93. A plurality of rolling balls 94 are mounted between the middle track 92 and the inner track 93 to allow easy sliding movement of the inner track 93 in the middle track 92. In order to allow easy assembly, the inner track 93 has a claw 95 with a resilient leg 96 and the middle track 92 has a stop 97. The resilient leg 96 can be pressed to allow a protrusion 951 of the claw 95 to move across a stop piece 971 of the stop 97, thereby allowing assembly or detachment between the inner track 93 and the middle track 92. After the inner track 93 has been engaged in the middle track 92, the protrusion 951 of the claw 95 is engaged with the stop piece 971 of the stop 97 when the inner track 93 is pulled outward, thereby preventing disengagement of the inner track 93 from the middle track 92. Such a track device can be used with drawers allowing pulling movement in a single direction, yet not applicable to drawers allowing pulling movements in two directions.

OBJECTS OF THE INVENTION

An object of the present invention is to provide a track device for drawers allowing pulling movements in two directions, wherein the drawer is retained in place by the track device when the drawers is pulled outward in either direction.

Another object of the present invention is to provide a track device for drawers allowing pulling movements in two directions, wherein the drawer is prevented from being disengaged while it is pulled outward in either direction.

SUMMARY OF THE INVENTION

To achieve the aforementioned objects, the present invention provides a track device comprising a first track and a second track. The first track includes a pair of guide walls. A limiting member is mounted to each of two ends of the first track. Each limiting member of the first track has two lateral walls and a groove between the lateral walls. Each limiting member of the first track further has a resilient hook extending into the groove of the limiting member. At least one positioning member is mounted to the first track and includes a resilient hook on a side thereof.

The second track is slidably received between the guide walls of the first track. The second track includes a limiting member on each of two ends thereof. Each limiting member of the second track includes two lateral walls one of which has a non-planar inclined face for selectively sliding across and engaging with the resilient hook of the positioning member of the first track and the resilient hook of a respective limiting member of the first track.

Other objects, advantages and novel features of this invention will become more apparent from the following detailed description when taken in conjunction with the accompanying drawings.

DETAILED DESCRIPTION OF THE PREFERRED EMBODIMENT

Figure 1:
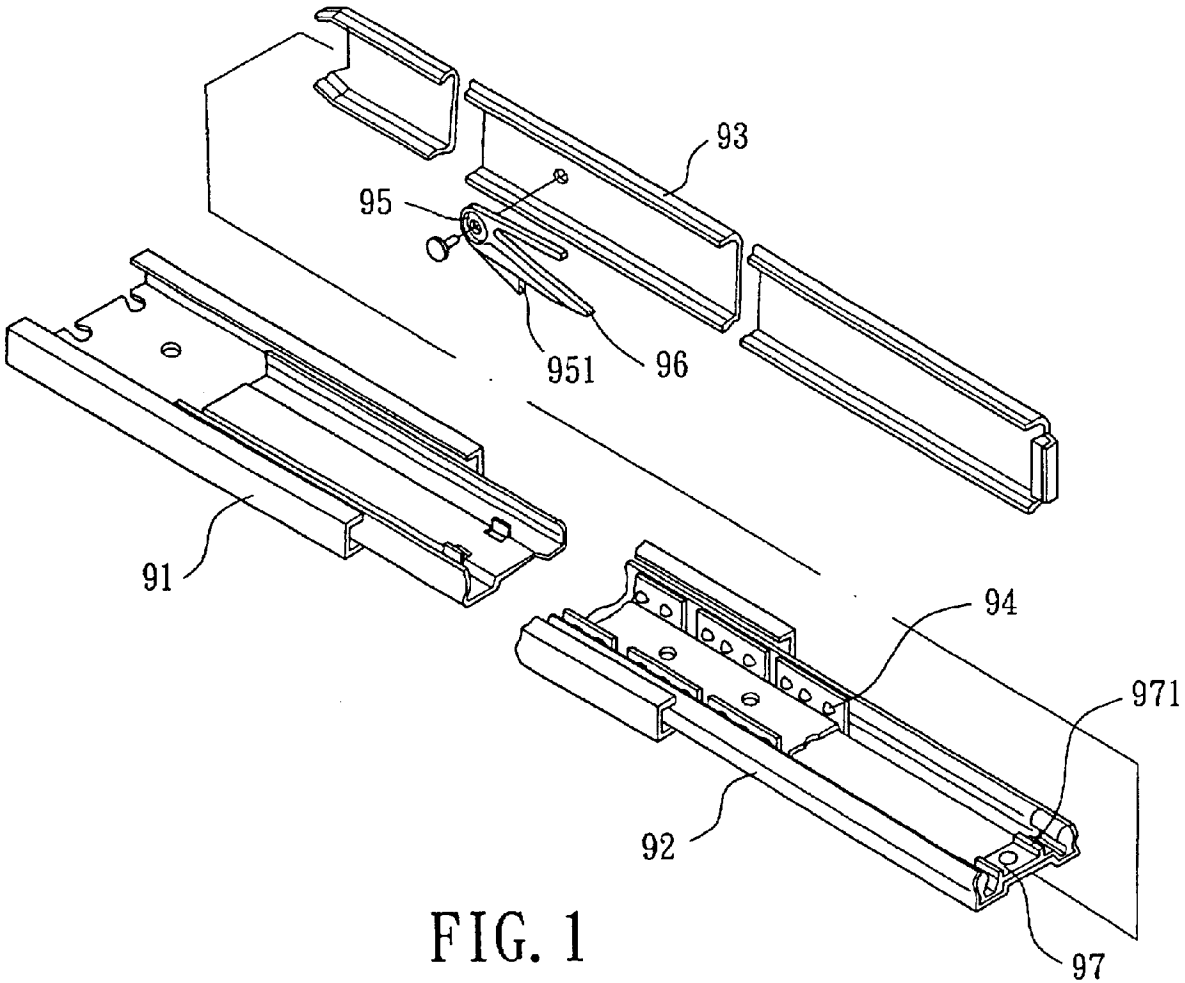
FIG. 1 PRIOR ART
FIG. 1 is an exploded perspective view of a conventional track device.
Figure 2:
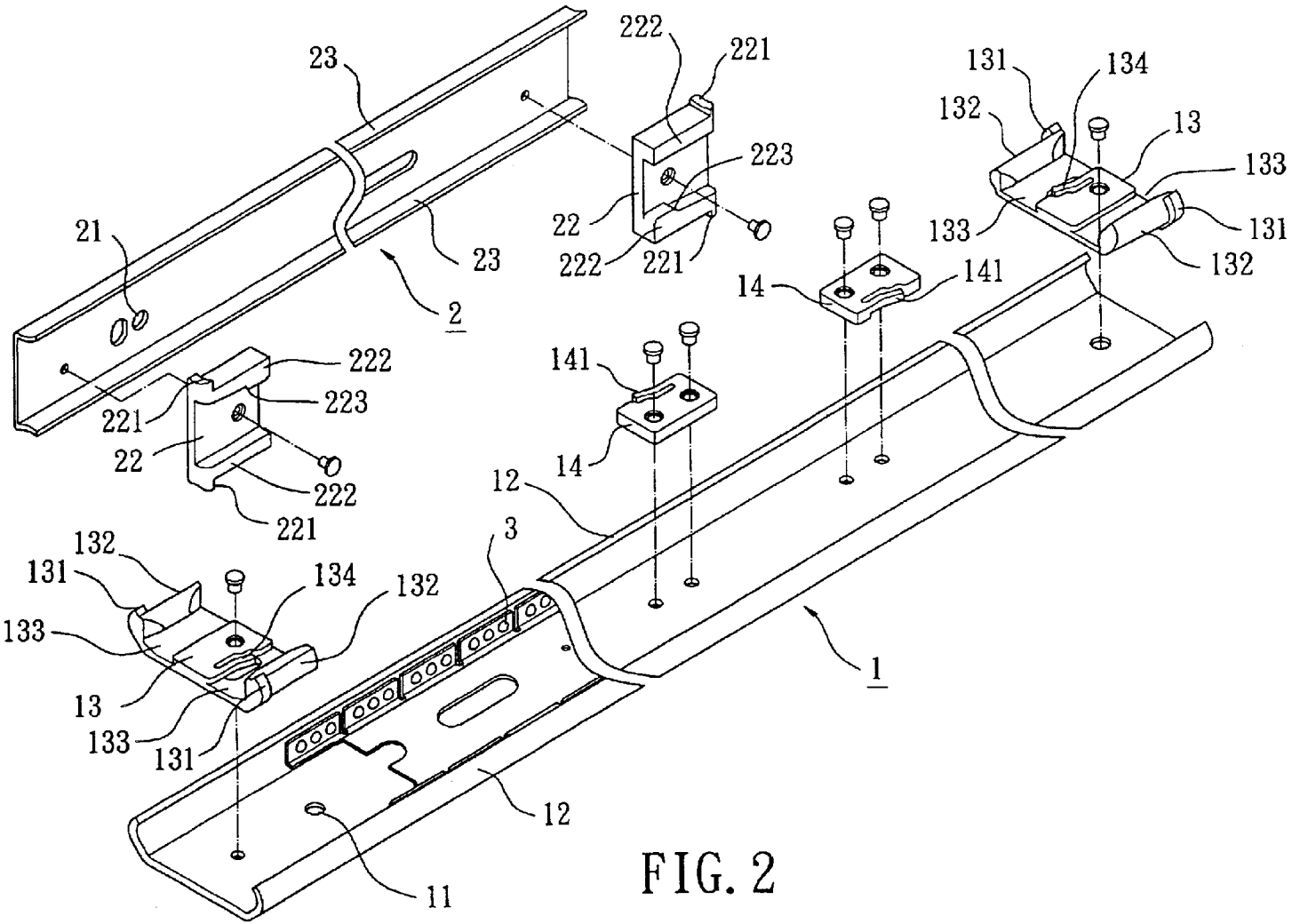
FIG. 2 is an exploded perspective view of a track device in accordance with the present invention.

Referring to FIG. 2, a track device in accordance with the present invention includes a first track 1 and a second track 2 that has a length substantially the same as that of the first track 1.

The first track 1 includes fixing holes 11 allowing the first track 1 to be fixed to a wall of furniture such as a cabinet. The first track 1 includes a pair of guide walls 12 on two opposed sides thereof for slidingly receiving the second track 2. Mounted between the first track 1 and the second track 2 are a slide-aiding member 3 having a plurality of rolling balls, allowing smooth sliding movement between the first track 1 and the second track 2.

Figure 3:
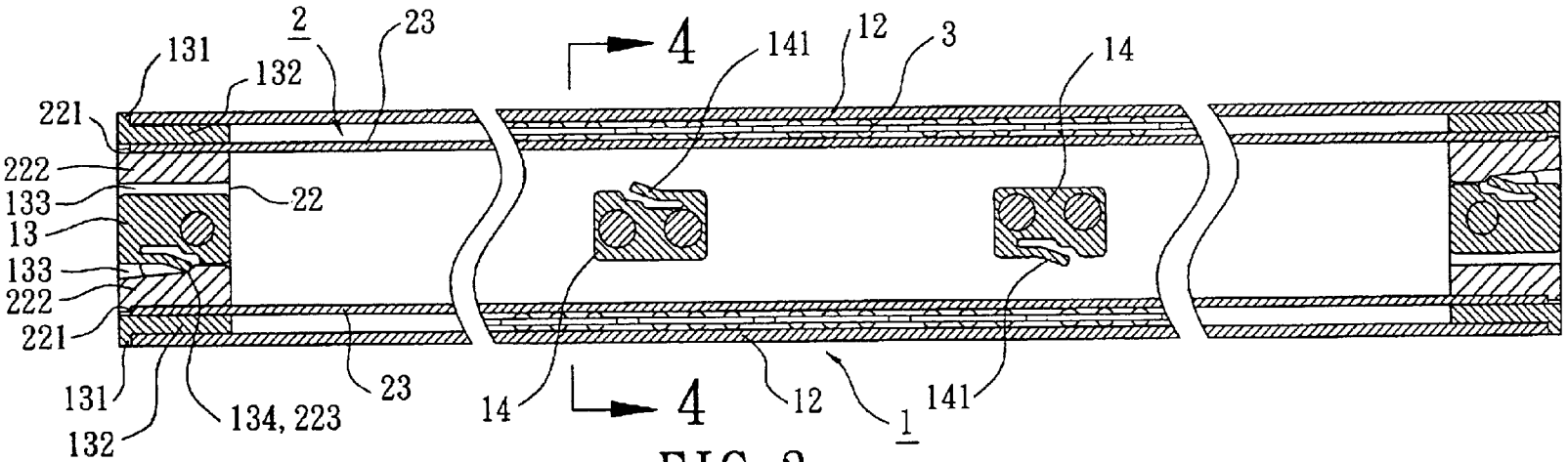
FIG. 3 is a sectional view of the track device in accordance with the present invention.

A limiting member 13 is mounted to each of two ends of the first track 1 and includes a protrusion 131 on each of two sides thereof. The protrusions 131 of each limiting member 13 abut against an end face of an associated end of the first track 1, as shown in FIG. 3. Each limiting member 13 further includes two lateral walls 132 each having a bulge (not labeled) on an inner wall face thereof. In this embodiment, the bulge of each lateral wall 132 prevents the slide-aiding member 3 from being disengaged from the track device. Further, a groove 133 is defined in each limiting member 13 and located between the lateral walls 132. The groove 133 is designed to receive an associated end of the second track 2. Each limiting member 13 further has a resilient hook 134 extending into the groove 133.

Two positioning members 14 are mounted to the limiting member 13 and each has a resilient hook 141. It is noted that the resilient hook 141 on one of the positioning members 14 is oriented opposed to that on the other positioning member 14 and that the resilient hook 134 on one of the limiting members 13 is oriented opposed to that on the other limiting member 13. Nevertheless, the resilient hooks 141 of the positioning members 14 and the resilient hooks 134 of the limiting members 13 may be oriented to face the same direction when desired.

The second track 2 is mounted between the guide walls 12 of the first track 1 and includes a pair of guide walls 23 in contact with the slide-aiding member 3, thereby allowing relative sliding movement between the first track 1 and the second track 2. The second track 2 is fixed to a side of a drawer of the furniture. A limiting member 22 is mounted to each of two ends of the second track 2 and includes a protrusion 221 on each of two sides thereof. The protrusions 221 of each limiting member 22 abut against an end face of an associated end of the second track 2, as shown in FIG. 3. Each limiting member 22 further includes two lateral walls 222 one of which has an inclined face 223 on an inner wall face thereof. The inclined face 223 on each limiting member 22 is not planar, and the resilient hook 134 of an associated limiting member 13 of the first track 1 abuts against the inclined face 23 of an associated limiting member 22 of the second track 2. Thus, when the second track 2 moves relative to the first track 1, the inclined face 23 of the respective limiting member 22 is engaged with or moves across the resilient hook 134 of the respective limiting member 13 of the first track 1 and the resilient hook 141 of the respective positioning member 14 of the first track 1, which will be described later.

Figure 4:
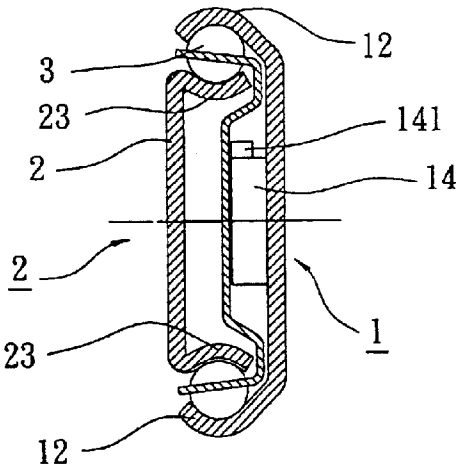
FIG. 4 is a sectional view taken along plane 4—4 in FIG. 3.

Referring to FIGS. 3 and 4, in assembly, the slide-aiding member 3 are mounted between the first track 1 and the second track 2 having a length substantially the same as that of the first track 1. The resilient hook 134 on the respective limiting member 13 of the first track 1 is engaged with the inclined face 223 of the respective limiting member 22 of the second track 2. In this case, the drawer is in a closed state. Preferably, each protrusion 221 of each limiting member 22 of the second track 2 abuts against an associated one of the lateral walls 132 of an associated one of the limiting members 13 of the first track 1 so that an unwanted outward movement of the second track 2 in either longitudinal direction with respect to the first track 1 is confined within the two limiting member 13.

Figure 5:
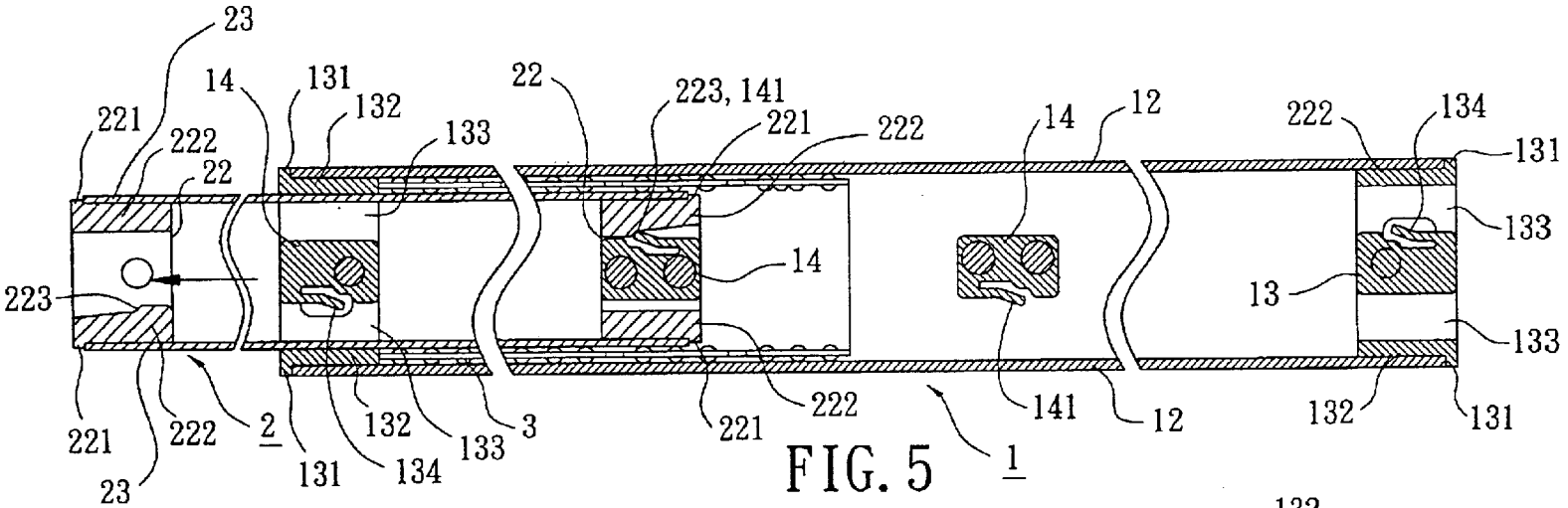
FIG. 5 is a sectional view similar to FIG. 3, wherein a second track is moved leftward relative to a first track.

Referring to FIG. 5, when the second track 2 is pulled, e.g., leftward relative to the first track 1, the resilient hook 134 of the left limiting member 13 of the first track 1 is depressed by the inclined face 223 of the left limiting member 22 of the second track 2 such that the second track 2 can be moved leftward until the inclined face 223 of the right limiting member 22 of the second track 2 moves across the resilient hook 141 of the left positioning member 14 of the first track 1. The resilient hook 141 of the left positioning member 14 returns to its original position due to its resiliency after the inclined face 223 of the right limiting member 22 of the second track 2 moves across the resilient hook 141 of the left positioning member 14 of the first track 1, providing a retaining effect for the second track 2 that prevents an unwanted inward (rightward) movement of the second track 2 with respect to the first track 1 in a longitudinal reverse direction. Further, the slide-aiding member 3 abuts against the left limiting member 13 of the first track 1, thereby stopping the slide-aiding member 3 and preventing disengagement of the second track 2 from the first track 1.

Closing of the drawer can be achieved by pushing the drawer in the reverse direction. The resilient hook 141 of the left positioning member 14 of the first track 1 is depressed by the inclined face 223 of the right limiting member 22 of the second track 2, allowing the second track 2 to move rightward until the second track 2 reaches a position shown in FIG. 3.

Figure 6:
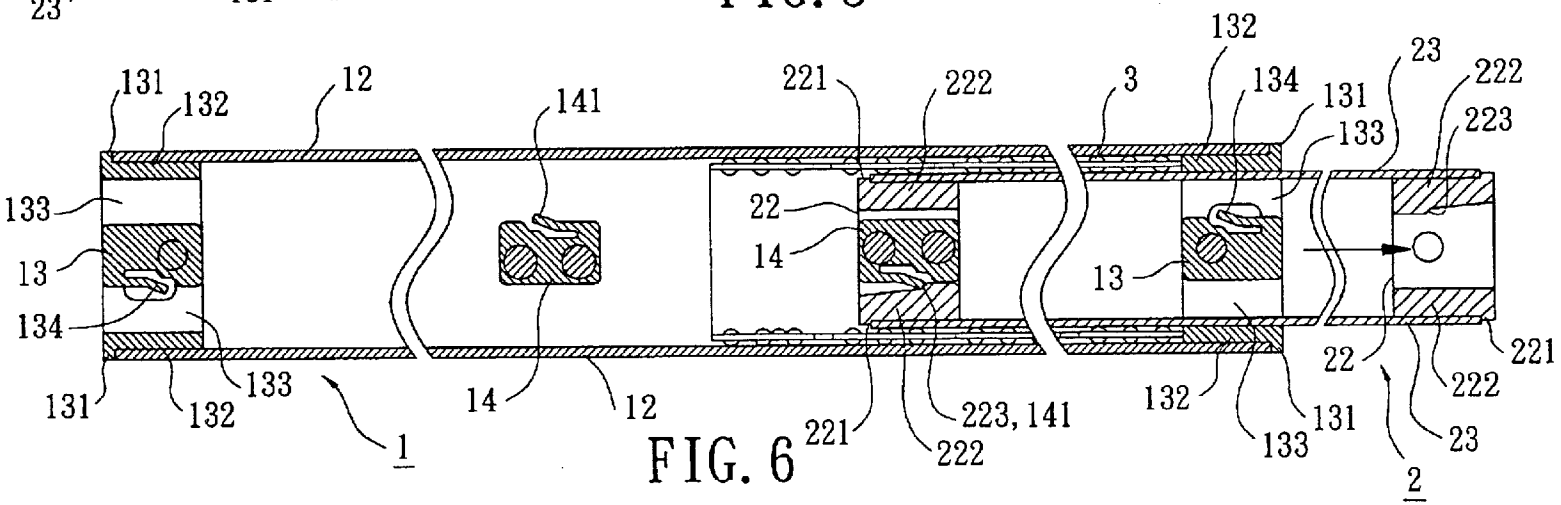
FIG. 6 is a sectional view similar to FIG. 3, wherein the second track is moved rightward relative to the first track.

Referring to FIG. 6, when the second track 2 is pulled, e.g., rightward relative to the first track 1, the resilient hook 134 of the right limiting member 13 of the first track 1 is depressed by the inclined face 223 of the right limiting member 22 of the second track 2 such that the second track 2 can be moved rightward until the inclined face 223 of the left limiting member 22 of the second track 2 moves across the resilient hook 141 of the right positioning member 14 of the first track 1. The resilient hook 141 of the right positioning member 14 returns to its original position due to its resiliency after the inclined face 223 of the left limiting member 22 of second track 2 moves across the resilient hook 141 of the right positioning member 14 of the first track 1, providing a retaining effect for the second track 2 that prevents an unwanted inward (leftward) movement of the second track 2 with respect to the first track 1 in a longitudinal reverse direction. Further, the slide-aiding member 3 abuts against the right limiting member 13 of the first track 1, thereby stopping the slide-aiding member 3 and preventing disengagement of the second track 2 from the first track 1. Closing the drawer can be achieved by pushing the drawer in the reverse direction.

Closing of the drawer can be achieved by pushing the drawer in the reverse direction. The resilient hook 141 of the right positioning member 14 of the first track 1 is depressed by the inclined face 223 of the left limiting member 22 of the second track 2, allowing the second track 2 to move rightward until the second track 2 reaches a position shown in FIG. 3.

In conclusion, when the drawer is closed, the inclined face 223 of each limiting member 22 of the second track 2 is engaged with the resilient hook 134 of the respective limiting member 13 of the first track 1, thereby retaining the second track 2 in place. When the second track 2 is moved relative to the first track 1 in either direction, the inclined face 223 of one of the limiting members 22 of the second track 2 is stopped by the resilient hook 141 of one of the positioning members 14 of the first track 1, thereby retaining the second track 2. Thus, the drawer can be opened in either direction. Further, the slide-aiding member 3 is prevented from falling from the track device, as the slide-aiding member 3 abuts against one of the limiting members 13 when the second track 2 is moved to a predetermined position relative to the first track 1. And the second track 2 is prevented from being disengaged from the first track 1.

While the principles of this invention have been disclosed in connection with its specific embodiment, it should be understood by those skilled in the art that these descriptions are not intended to limit the scope of the invention, and that any modification and variation without departing the spirit of the invention is intended to be covered by the scope of this invention defined only by the appended claims.

What is claimed is:

1. A track device comprising:

a first track including a pair of guide walls and two ends, a pair of first limiting members each being mounted to respective ones of the ends of said first track, each said first limiting members of said first track having two lateral walls and a groove between said lateral walls, each said first limiting members of said first track further having a resilient hook extending into said groove of a respective one of said first limiting members, at least one positioning member being mounted to said first track between said first limiting members and including a resilient hook on a side thereof; and a second track slidably received between said guide walls of said first track, said second track including a pair of second limiting members on respective ones of two ends of said second track, each said second limiting members of said second track including two lateral walls one of which has a non-planar inclined face for sliding across and engaging with said resilient hook of said at least one positioning member of said first track to prevent an unwanted inward movement of said first track in a longitudinal direction with respect to said first track, and one of said non-planar inclined faces of one of said second limiting members is engaged with said resilient hook of a respective one of said first limiting members of said first track to prevent an unwanted outward movement of said first track in either longitudinal direction with respect to said first track.

2. The track device as claimed in claim 1, wherein said second track includes a pair of guide walls, further including a slide-aiding member mounted between said first track and said second track.

3. The track device as claimed in claim 1, wherein each of said second limiting members of said second track has two protrusions that abut against an end face of a respective end of said second track.

4. The track device as claimed in claim 3, wherein each said protrusion of each said second limiting members of said second track abuts against an associated one of said lateral walls of an associated one of said first limiting members of said first track.

5. A track device for a drawer of furniture, the track device comprising:

a first track mounted to one of said drawer and said furniture, the first track including a pair of guide walls and two ends, a limiting member being mounted to each of the ends of said first track, each said limiting member of said first track having two lateral walls and a groove between said lateral walls, each said limiting member of said first track further having a resilient hook extending into said groove of said limiting member, two positioning members being mounted to said first track and each including a resilient hook on a side thereof; and a second track mounted to the other of said drawer and said furniture, the second track being slidably received between said guide walls of said first track, said second track including a limiting member on each of two ends thereof, each said limiting member of said second track including two lateral walls one of which has a non-planar inclined face;

wherein when the drawer is in a closed state, said inclined face of each said limiting member is engaged with said resilient hook of a respective limiting member of said first track, thereby retaining said second track in place; and wherein when said second track is moved relative to said first rack in either direction for moving the drawer to an open position, said inclined face of one of said limiting members of said second track slides across said resilient hook of a respective limiting member of said first track until said inclined face of the other limiting members of said second track engages with said resilient hook of a respective positioning member of said first rack.

6. The track device as claimed in claim 5, wherein said second track includes a pair of guide walls, further including a slide-aiding member mounted between said first track and said second track.

7. The track device as claimed in claim 5, wherein each said limiting member of said second track has two protrusions that abut against an end face of a respective end of said second track.

8. The track device as claimed in claim 7, wherein each said protrusion of each said limiting member of said second track abuts against an associated one of said lateral walls of an associated one of said limiting members of said first track.

9. The track device as claimed in claim 5, wherein said resilient hook of one of said positioning members of said first track is oriented toward a direction opposite to that of said resilient hook of the other positioning member of said first track.

10. The track device as claimed in claim 5, wherein said resilient hook of one of said limiting members of said first track is oriented toward a direction opposite to that of said resilient hook of the other limiting member of said first track.

* * * * *